United States Patent [19]

Hess

[11] 4,365,138

[45] Dec. 21, 1982

[54] HEATED INSTRUMENT-MOUNTING PLATE

[76] Inventor: Joachim Hess, Schröplerstrasse 37, 8070 Ingolstadt, Fed. Rep. of Germany

[21] Appl. No.: 179,979

[22] Filed: Aug. 21, 1980

Related U.S. Application Data

[63] Continuation of Ser. No. 937,815, Aug. 29, 1978, abandoned.

[30] Foreign Application Priority Data

Aug. 31, 1977 [DE] Fed. Rep. of Germany ..... 2739123

[51] Int. Cl.[3] ..... H05B 1/03

[52] U.S. Cl. ..... 219/200; 219/201; 219/443; 219/449

[58] Field of Search ..... 219/200, 201, 205–207, 219/209, 530, 540, 432, 443, 473, 520, 521, 242, 457, 449–453, 455, 459, 481; 338/252, 267, 291, 321, 296, 305, 53, 55, 57, 58, 226, 236, 293; 174/58, 52 R; 361/331, 346, 386; 211/13

[56] References Cited

U.S. PATENT DOCUMENTS

| | | | |
|---|---|---|---|
| 931,605 | 8/1909 | Hermansen et al. | 219/201 |
| 1,458,940 | 6/1923 | Hynes | 219/481 |
| 1,703,640 | 2/1929 | Schmidt-Predari | 219/345 |
| 1,803,310 | 5/1931 | Basseches | 361/420 |
| 2,487,161 | 11/1949 | Melton | 219/521 |
| 2,680,185 | 6/1954 | Basile | 219/205 |
| 3,286,082 | 11/1966 | Norton | 219/457 |
| 3,600,552 | 8/1971 | Tolmie | 219/242 |
| 3,606,019 | 9/1971 | Dubiel | 361/346 |
| 3,610,878 | 10/1971 | Thomas et al. | 219/242 |

FOREIGN PATENT DOCUMENTS

| | | | |
|---|---|---|---|
| 695348 | 9/1964 | Canada | 219/443 |
| 2347284 | 10/1975 | Fed. Rep. of Germany | 361/346 |
| 2359215 | 12/1975 | Fed. Rep. of Germany | 219/449 |
| 889847 | 1/1944 | France | 219/459 |
| 86703 | 10/1955 | Norway | 174/52 R |
| 450520 | 4/1968 | Switzerland | 174/58 |

*Primary Examiner*—Roy N. Envall, Jr.
*Assistant Examiner*—Bernard Roskoski
*Attorney, Agent, or Firm*—Karl F. Ross

[57] ABSTRACT

A flat plate of thermally conductive material, such as aluminum, has mounting holes for connecting it on one side on a support and on the other side to an instrument which is to be thermally stabilized. The plate is internally traversed by a heating wire and is recessed near one of its edges to provide a platform on which temperature-sensing control elements such as a thermostat, a heat limiter and an alarm indicator can be positioned in close proximity to the wire. The platform is encased by a housing in which these elements and their connections are embedded in synthetic potting resin.

6 Claims, 3 Drawing Figures

HEATED INSTRUMENT-MOUNTING PLATE

CROSS-REFERENCE TO RELATED APPLICATION

This is a continuation of my copending application Ser. No. 937,815, filed Aug. 29, 1978 and now abandoned.

FIELD OF THE INVENTION

My present invention relates to a device for mounting various process-monitoring or process-controlling instruments on an outside support, particularly instruments used in the chemical (e.g. petrochemical) field that are at least indirectly exposed to the weather and which often must be heated for proper functioning.

BACKGROUND OF THE INVENTION

In order to mount a process-monitoring or process-controlling instrument or the like in a box or on a support rail it is standard practice to make up a mounting plate or bracket specifically for the instrument involved. Such a custom-made device is relatively expensive.

It is also frequently necessary to provide such an instrument with some arrangement for controlling its temperature. In particular, when electronic monitoring devices are mounted outside, whether on a support rail or in an instrument box, it is necessary to prevent the temperature of the instrument from exceeding approximately 70° C. to avoid damage to the semiconductors in the circuit thereof. It is also often necessary to heat the instruments in situations where they are likely to reach very low temperatures, as where viscous or crystallizing fluids are being monitored or controlled. Providing a heater in a normally tightly packed instrument box is difficult without considerably increasing the size thereof. Moreover, it is normally necessary to mount the heater at some distance from the instrument to be heated so that more heat than required must be generated in view of the inefficiency of heat transfer.

OBJECTS OF THE INVENTION

It is therefore an object of the instant invention to provide an improved device for the dual purpose of controlling the temperature of such an electronic instrument and mounting it on a support.

Another object is to provide such a mounting device with effective temperature-sensing means.

SUMMARY OF THE INVENTION

A device according to my invention, designed to mount an instrument under thermally stabilized conditions on a support, comprises a perforated plate of good thermal conductivity with parallel surfaces which are respectively engageable by an instrument to be mounted thereon and by a support serving to carry the plate, the instrument and the support being connectable with that plate by fastening means traversing its perforations. The plate is internally provided with heating means forming a loop between its two parallel surfaces and with temperature-sensing means on one of these surfaces disposed close to the heating means for controlling the operation thereof while being enclosed in a housing secured to the plate.

Pursuant to a more particular feature of my invention, one of the plate surfaces is recessed adjacent an edge thereof to form a supporting base for the temperature-sensing means in close proximity to the heating means; the base is overhung by the housing which adjoins the aforementioned edge and forms a compartment for circuit connections extending from a pair of terminals of a resistance wire serving as the heating means. Advantageously, the sensor-carrying base on one plate surface (the upper one in the specific embodiment described hereinafter) lies opposite a recess in the other (lower) plate surface designed to provide an air space between the base-forming plate portion and a support contacting the last-mentioned (lower) surface in the vicinity of the housing. In this manner the temperature sensor or sensors can quickly respond to temperature changes exceeding a predetermined threshold and can take corrective measures before the instrument mounted on the plate is overheated; the air space at the plate surface opposite the base minimizes thermal leakage between the heater and the support at a location where such leakages might affect the sensor response.

The above and other features of my invention will now be described in detail with reference to the accompanying drawing in which:

SPECIFIC DESCRIPTION

Figure 1:
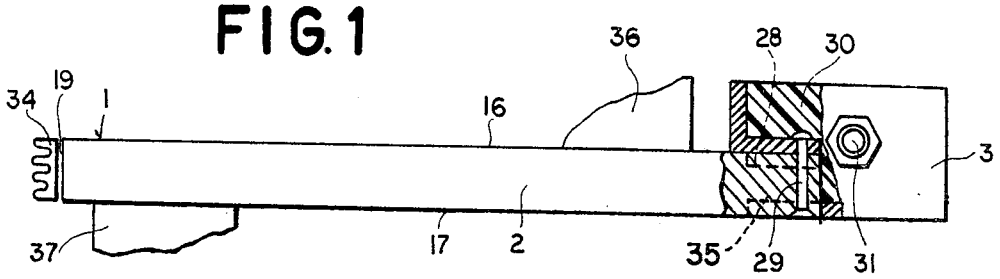
FIG. 1 is a side view of a device according to this invention, shown partly in section.
Figure 2:
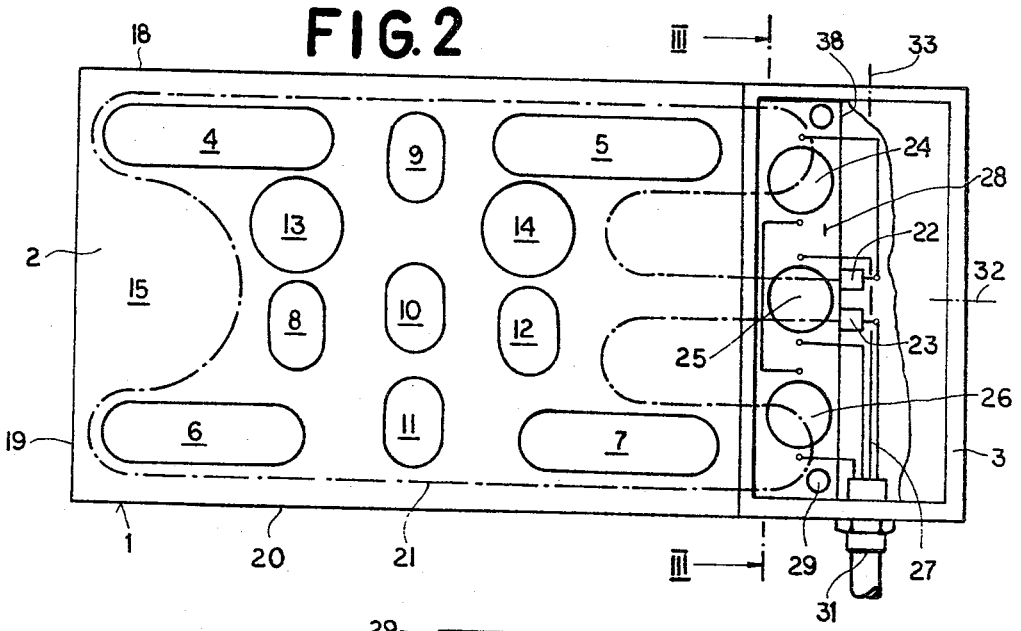
FIG. 2 is a partly schematic top view of the device shown in FIG. 1.
Figure 3:
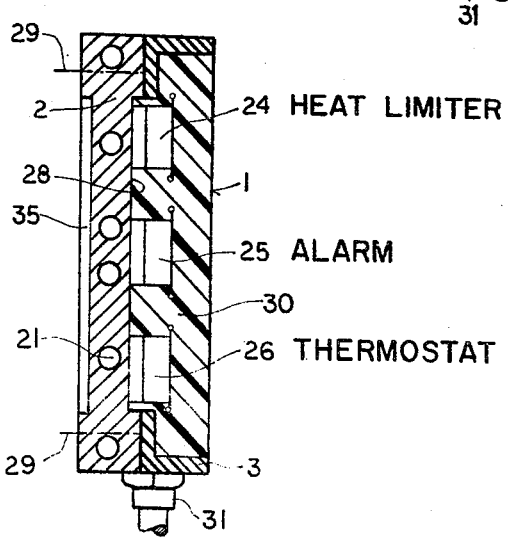
FIG. 3 is a cross-sectional view taken along line III—III of FIG. 2.

As shown in the drawing, a device 1 according to this invention basically comprises a rectangular aluminum-alloy plate 2 carrying at one of its minor edges a control 1 compartment defined by a housing or box 3. The plate 2 is formed with four longitudinally extending slots 4–7 and with five transversely extending slots 8–12, as well as with two throughgoing holes 13 and 14 adapted to receive projections on an instrument such as the one partially shown at 36 in FIG. 1. The various holes 4–12 serve for the bolting of instrument 36 to the plate 2, as well as for a bolting of the plate in turn to a support such as that shown at 37 in FIG. 1. Furthermore, the plate has an imperforate region 15 so that an oddly dimensioned instrument can be secured to it by appropriate drilling and tapping of this region 15. The upper and lower surfaces 16 and 17 of the plate 2 are planar and the major side edges 18 and 20 as well as the other minor edge 19 extend perpendicular thereto. A ribbed rail as shown at 34 in FIG. 1 may be secured to any of the edges 18–20 for heat dissipation into the surrounding air.

The plate 2 is internally formed with a heating loop extending along a meandering path 21 that skirts the holes 4–14 and the solid region 15. This path 21 is defined by an electrical resistance wire having ends 22 and 23 exposed at the minor edge 38 of the plate 2. The wire is potted in place for maximum heat conduction to the aluminum-alloy plate 2. It is also possible simply to design the path 21 as a conduit for a heat-exchange fluid such as steam, water or oil.

In the control housing 3 there is provided a heat limiter 24, an alarm 25, and a thermostat 26, all connected together via wiring 27. The limiter 24 is connected to terminal 22 to reduce power input to the heater as a predetermined temperature is reached and the thermostat 26 completely cuts off the heater upon attainment of this temperature. The alarm 25 is actuated when a predetermined temperature is exceeded, so that in an explosive atmosphere the device can be made very sensitive to any malfunctioning. Underneath the temperature-sensing control elements 24–26 the plate 2 is recessed so that these elements can rest flat on a depressed base 28 formed by the upper plate surface in close proximity to heater 21. The opposite face of the plate is formed with a similar recess 35 so that, even if the plate 2 is bolted to a planar support in the region of thermostat 26, that thermostat will not be significantly cooled by conduction into this support and will therefore read properly. The reduction of the plate thickness by recess 28 accelerates the response of the temperature sensors and thus minimizes overcorrections due to thermal lag.

Rivets 29 secure the housing 3 to the plate 2 and the elements 24–26 are all imbedded in synthetic-resin potting 30. The wiring 27 is joined to a threaded connector 31 along one major edge of the plate, yet this connector 31 may also be provided at a location 32 or 33 depending on the position the arrangement is to be used in.

With the device 1 according to the instant invention it is possible to bolt a variety of standard instruments to plate 2 and to bolt that plate in turn to various standard supports, such as housings or rails. The circuitry inside the housing 3 can control the temperature of the plate 2 with very close tolerance, so that this mounting plate serves the double function of properly heating the instrument 36 and holding it securely in place.

I claim:

1. A device for mounting an instrument under thermally stabilized conditions on a support, comprising:

a perforated plate of good thermal conductivity with parallel surfaces respectively engageable by an instrument and by a support connectable with said plate by fastening means traversing the perforations thereof;

heating means in said plate forming a loop between said surfaces;

temperature-sensing means on one of said surfaces disposed close to said heating means for controlling the operation thereof, said one of said surfaces being recessed adjacent an edge thereof to form a supporting base for said temperature-sensing means in close proximity to said heating means; and a housing secured to said plate, said temperature-sensing means being enclosed in said housing, the other of said surfaces being recessed opposite said base to provide an air space between a part of said plate forming said base and a support contacting said other of said surfaces in the vicinity of said housing.

2. A device as defined in claim 1 wherein said housing adjoins said edge and overhangs said base, said heating means comprising a wire with terminals projecting from said edge and circuit connections extending from said terminals inside said housing.

3. A device as defined in claim 2 wherein said housing is filled with potting material enveloping said temperature-sensing means, said terminals and said circuit connections.

4. A device as defined in claim 1, 15 or 16 wherein said plate is substantially rectangular, said edge defining a minor side of the rectangle.

5. A device as defined in claim 1, 2 or 3 wherein said temperature-sensing means comprises a thermostat and a heat limiter.

6. A device as defined in claim 5, further comprising heat-sensitive alarm means in said housing resting on said base.

* * * * *